US012247447B2

(12) United States Patent
Frade et al.

(10) Patent No.: US 12,247,447 B2
(45) Date of Patent: Mar. 11, 2025

(54) DECOUPLING WRENCH FOR UNLOCKING DRILL BITS, SYSTEM FOR REPLACING DRILL BITS, AND METHOD FOR REPLACING DRILL BITS

(71) Applicant: Vale S.A., Rio de Janeiro (BR)

(72) Inventors: Enilton Edson Frade, Itabira (BR); Bruno Fonseca Vaz, João Monlevade (BR); Arlem Flávio De Sena, Itabira (BR)

(73) Assignee: VALE S.A., Rio de Janeiro (BR)

( * ) Notice: Subject to any disclaimer, the term of this patent is extended or adjusted under 35 U.S.C. 154(b) by 0 days.

(21) Appl. No.: 18/573,734

(22) PCT Filed: Jul. 13, 2022

(86) PCT No.: PCT/BR2022/050256
§ 371 (c)(1),
(2) Date: Dec. 22, 2023

(87) PCT Pub. No.: WO2023/019331
PCT Pub. Date: Feb. 23, 2023

(65) Prior Publication Data

US 2024/0328264 A1 Oct. 3, 2024

(30) Foreign Application Priority Data

Aug. 18, 2021 (BR) ..... 1020210163321

(51) Int. Cl.
*E21B 19/18* (2006.01)
*E21B 12/00* (2006.01)

(52) U.S. Cl.
CPC ..... *E21B 19/18* (2013.01); *E21B 12/00* (2013.01)

(58) Field of Classification Search
CPC ..... E21B 19/18; E21B 12/00
See application file for complete search history.

(56) References Cited

U.S. PATENT DOCUMENTS 1,806,912 A * 5/1931 Owen ..... E21B 12/00 269/236
3,957,113 A * 5/1976 Jones ..... E21B 19/164 81/57.33

(Continued)

FOREIGN PATENT DOCUMENTS

WO 2019226096 A1 11/2019

OTHER PUBLICATIONS

International Search Report and Written Opinion issued in International Patent Application No. PCT/BR2022/050256 on Sep. 9, 2022.

*Primary Examiner* — Aaron L Lembo
(74) *Attorney, Agent, or Firm* — ArentFox Schiff LLP

(57) ABSTRACT

A device for unlocking bits from a drill, the drill comprising an articulated drill string with a percussion hammer that receives bits at its end, the device for bit unlocking comprising a decoupling wrench which is mounted on the drill and being movable between an extended position, in which the decoupling wrench is aligned with a drill hole of the pivotable drill string, and between a retracted position, in which the decoupling wrench is away from the pivotable drill string, wherein the decoupling wrench comprises: a central slot for receiving the bit coupled to the percussion hammer, and a wide range of recesses located on the inner surface of the central slot, wherein the recesses are arranged to accommodate protrusions of the bit of the percussion hammer and prevent rotational movement of the bit when the bit is accommodated in the decoupling wrench.

9 Claims, 23 Drawing Sheets

(56) References Cited

U.S. PATENT DOCUMENTS 4,057,887 A * 11/1977 Jones ..... E21B 19/164 81/57.21
4,128,135 A 12/1978 Mitchhart et al.
4,352,399 A * 10/1982 Davis ..... E21B 19/18 173/164
4,495,840 A * 1/1985 Freitag ..... E21B 19/18 81/57.21
4,974,686 A * 12/1990 Hisey ..... E21B 19/20 173/164
6,311,789 B1 * 11/2001 Saxman ..... E21B 19/18 175/57
6,505,531 B2 * 1/2003 Stogner ..... E21B 19/18 81/57.24
7,117,938 B2 * 10/2006 Hamilton ..... E21B 19/163 81/57.24
8,317,448 B2 * 11/2012 Hankins ..... E21B 19/14 414/22.68
8,453,542 B2 * 6/2013 Gouws ..... E21B 19/163 81/57.2
9,404,325 B2 * 8/2016 Pop ..... E21B 19/18
9,644,436 B2 5/2017 Hoult et al.
10,246,953 B2 * 4/2019 Gonzalez ..... E21B 19/18
10,597,956 B2 3/2020 Gaska et al.
11,136,839 B2 * 10/2021 St. Pierre ..... E21B 19/18
11,391,101 B2 * 7/2022 Odegard ..... E21B 19/18
2010/0065455 A1 * 3/2010 Weaver ..... E21B 10/00 206/349
2011/0138969 A1 * 6/2011 Gouws ..... E21B 19/163 81/57.33
2015/0315859 A1 * 11/2015 Strydom ..... E21B 17/1085 166/85.5
2017/0234086 A1 * 8/2017 Gaska ..... E21B 19/18 175/85
2018/0291696 A1 * 10/2018 Amerson ..... E21B 19/18
2021/0198960 A1 7/2021 Branson et al.

* cited by examiner

DECOUPLING WRENCH FOR UNLOCKING DRILL BITS, SYSTEM FOR REPLACING DRILL BITS, AND METHOD FOR REPLACING DRILL BITS

CROSS-REFERENCE TO RELATED APPLICATIONS

This application is a 35 U.S.C. § 371 National Phase of PCT Application No. PCT/BR2022/050256, filed on Jul. 13, 2022, which claims priority to Brazilian patent application Ser. No. 10/202,10163321, filed on Aug. 18, 2021, the disclosures of which are hereby incorporated by reference herein in their entireties.

TECHNICAL FIELD

The present invention relates to a decoupling wrench for unlocking drill bits, a system and method for replacing bits used in drills in well drilling. Well drilling rigs are common in the mining process to drill through tough rocks.

BASICS OF THE INVENTION

In the current state of the art, well drilling rigs are generally known to have a vertical drill string, which is constructed from structural members such as steel beams and reinforcing supports. The drill string extends vertically from a base and a drill pipe, which is coupled and supported by said derrick, and extends to a wellbore. Coupled to the end of the drill pipe is the presence of a ground penetrating tool to drill into the rock or soil. The drilling column is coupled to the equipment chassis through the drilling derrick, where it is pivoted and locked by the angle scale and can be coupled to a mobile platform, allowing mobility to the desired location to carry out the drilling operation.

Drill bits are worn out during the drilling process and need to be replaced after a certain period of use. However, many bit replacement operations involve replacing the entire percussion hammer and not just the worn bit, in addition to involving several manual processes or hydraulic drives, which can bring risks of leaks and accidents in this maintenance process. Finding ways to automate these processes can not only result in better equipment maintenance, but also reduce costs, increase safety and efficiency. One of these tasks is to replace only the worn drill bit, which is a heavy and dangerous component and can cause accidents.

Document BRI 020170027 45-7 includes a drill string having an assembly for changing drill bits, which includes a bit container actuator assembly configured to be coupled to a drilling equipment. The revealed bit changing assembly includes a bit container actuator assembly, a mounting assembly coupled to the drilling rig, and a carousel rotatably coupled to the mounting assembly. The revealed carousel can store up to five drill bits, where three bits will be stored to replace the bit in use when worn out during the drilling process.

Replacing the bit occurs by raising it above the drilling equipment to a desired height, where the bit container is actuated by the actuators from a "stored position", in which the bit container in the form of a carousel and coupled to the drilling derrick, is spaced from an opening to an "extended position" in which the opening of the bit container is concentric with the opening and the drill bit. As the drill bit is lowered, it is guided into the bit container by each protrusion adjacent to the opening and the protrusions engage between adjacent lobes of the drill bit.

In this way, a wrench is then pivoted towards the drill pipe to engage it and unscrew the drill bit. When the drill pipe and drill bit are decoupled, the drill pipe is driven vertically to provide clearance between the drill pipe and the rig bushing, allowing the worn bit to be replaced with one of the bits stored in the carousel.

U.S. Pat. No. 9,644,436 B2 discloses an apparatus for changing the drilling tool on a drilling rig, which includes a pivotable drill string. The apparatus also includes a drilling tool storage device, comprising a replacement drilling tool storage cassette. For drilling tool change to occur, a hydraulically operated decoupling wrench arranged near the base of the drill string and rig is engaged with the drilling tool and the drilling motor rotates the drill pipe to at least partially release the drilling tool from the lower end of the lowest drill pipe in the drill string so that the drilling tool is prepared for replacement. In this way, the drill string is tilted, the drilling tool is extended until its lower end is disposed close to a leading edge of a storage device, which is pivotally raised over the shaft connection of the front hinge of the position. retracted to the extended position to receive the drilling tool, disengaging the entire percussion hammer in the open storage receptacle within the storage device cassette. Consequently, the worn bit, together with the percussion hammer, are replaced.

From this scenario, the need arises to use a device and methodology that allows only the worn bit to be replaced during the drilling process, instead of completely replacing the percussion hammer, and replacing the worn bits with new bits in a storage equipment without a long interruption of the drilling process, therefore without the presence of a bit storage carousel, where replacement of bits is more time-consuming and limited, since the carousel storage cannot be expanded and additionally, there is still the use of a hydraulic drive, which promotes less reliability and safety in the bit replacement process when causing hydraulic leaks. Therefore, a simpler and safer drive model is necessary, bringing reliability and safety to the bit replacement process.

OBJECTIVES OF THE INVENTION

The objective of the present invention is to provide a decoupling wrench that unlocks a bit worn out in the drilling process, keeping the percussion hammer fixed in the drilling column, so that said bit is replaced by a new bit autonomously, safe and with low interruption during the aforementioned drilling process.

A further object of the present invention is to provide a system comprising means for replacing a worn bit in the drilling process using a coupling wrench and a storage device, where, autonomously, the worn bits will be deposited and the bits new ones will be removed.

It is another object of the present invention to provide a method that allows worn bits to be unlocked in the drilling process of a percussion hammer, move the worn bit to a storage device and replace the worn bit with a new bit autonomously and with low interruption during the aforementioned drilling process.

INVENTION SUMMARY

The present invention relates to a decoupling wrench for unlocking bits from a drill, the drill comprising a pivotable drill string with a percussion hammer that receives bits at its end, the device for unlocking bits comprises a decoupling wrench that is mounted on the drill and is movable between an extended position, in which the decoupling wrench is aligned with a drill hole of the pivoting drill string, and between a retracted position, in which the decoupling wrench is away from the articulated drill string;

wherein the decoupling wrench comprises:

a central slot to receive the bit coupled to the percussion hammer, and a wide range of recesses located on the inner surface of the central slot, wherein the recesses are arranged to accommodate protrusions of the percussion hammer bit and prevent rotational movement of the bit when the bit is accommodated in the decoupling wrench.

Additionally, the present invention also relates to a system for replacing drill bits, the drill comprising a pivotable drill string with a percussion hammer that receives bits at its end, the system comprising:

a decoupling wrench mounted on the percussion hammer, the decoupling wrench being movable between an extended position, in which the decoupling wrench is aligned with a drill hole of the pivotable drill string, and between a retracted position, in which the decoupling wrench is spaced away from the pivotable drill string, the decoupling wrench comprising:

a central slot to receive the bit coupled to the percussion hammer, and a wide range of recesses located on the inner surface of the central slot, wherein the recesses are arranged to accommodate protrusions of the percussion hammer bit and prevent rotational movement of the bit when the bit is accommodated in the decoupling wrench;

a coupling wrench set up to apply torque to the percussion hammer when the bit is positioned in the decoupling wrench;

a bit storage device comprising:

a bit cradle carriage set up to move on rail to align with the percussion hammer;

a bit housing comprising a wide range of receptacles;

a drilling control device of the drill set up to hydraulically actuate the decoupling wrench, the tilting movement of the bit housing of the bit storage device, the engagement wrench and the percussion hammer.

The present invention also relates to a method for replacing bits of a drill, the drill comprising a pivotable drill string with a percussion hammer that receives bits at its end, comprising the steps of:

position the percussion hammer bit on a decoupling wrench to unlock bits;

unlock the percussion hammer bit by rotating the percussion hammer in a first direction;

move the percussion hammer with the bit unlocked to a receptacle, the receptacle comprising means for locking the rotational movement of the bit;

rotate the percussion hammer in a second direction, opposite to the first direction, to disconnect the unlocked bit inside the receptacle, Connect a spare bit to the percussion hammer.

DETAILED DESCRIPTION OF THE PRESENT INVENTION

The present invention relates to a decoupling wrench for unlocking bits from a drill, a system for replacing drill bits and a method of replacing bits. More precisely, the decoupling wrench works in conjunction with a system to carry out the bit replacement method, which allows a worn bit to be replaced by a spare bit with low impact of interrupting the drilling operation, in addition to being carried out in a safely manner, through commands from the operating cabin.

Although the present device, system and method are presented in the use of a mobile drilling rig, this is only one of the embodiments within the scope of the present invention.

Figure 1:
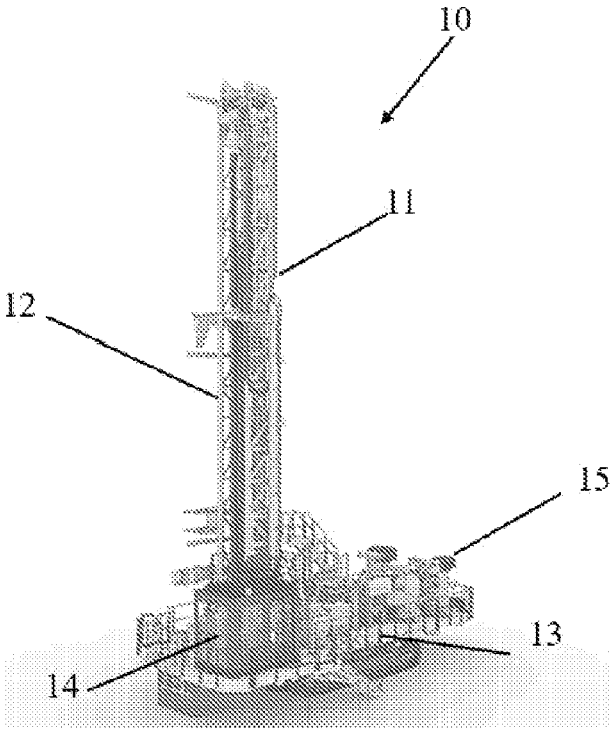
FIG. 1 shows a perspective view of a drill, which includes the bit changing device.

FIG. 1 shows an embodiment of the drill 10, which includes a drilling derrick 11, a drilling string 12, a base 13 that supports the drilling derrick 11, the operating cabin 14 coupled to the base 13 and a machine room 15. The drill string 12 is configured to extend downwards vertically into a well and at its lower end is attached a percussion hammer, where a drill bit is installed.

Figure 2:
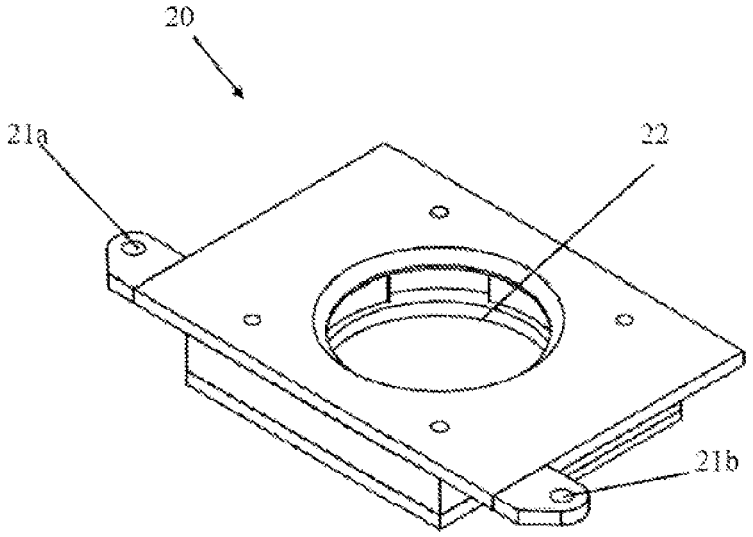
FIG. 2 shows an isometric view of the decoupling wrench.

FIG. 2 shows a decoupling wrench 20, which will be used to break bit torque, which represents the function of unlocking a bit of percussion hammer 50 so that said bit can be replaced by another. The decoupling wrench 20 is fixed to the lower end of the drilling derrick 11 through tabs that extend outwards (21*a*, 21*b*) from the actuation of hydraulic cylinders (54*a*, 54*b*), being positioned posterior to the drill string 12 and immediately above the drill hole. The decoupling wrench 20 will move from a retracted position 20*a* to an extended position 20*b* upon a command from the operating cabin 14. The lower end of the drill string 12, which comprises the percussion hammer 50, will be engaged in central slot 22 of the decoupling wrench 20.

Figure 2A:
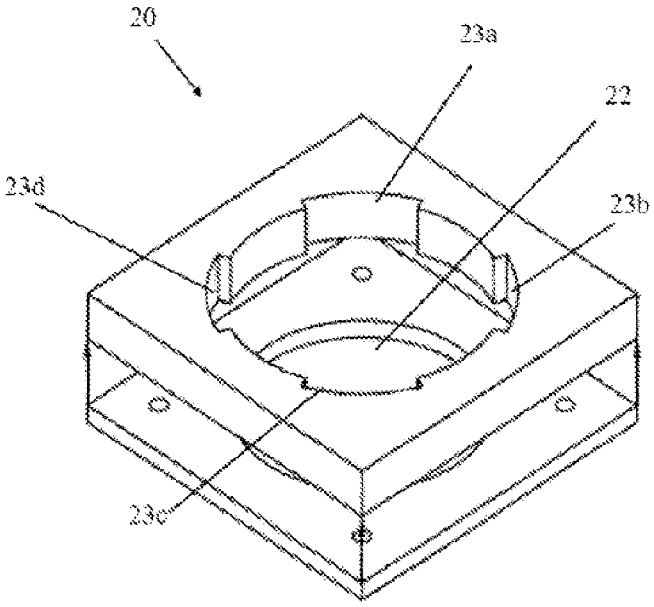
FIG. 2*a* shows an exploded and bottom view of the decoupling wrench.

As can be seen in FIG. 2*a*, which illustrates an exploded and bottom view of the decoupling wrench 20, which comprises central slot 22 and a wide range of recesses 23*a*, 23*b*, 23*c*, 23*d*. From the engagement of the percussion hammer 50 into the central slot 22 of the decoupling wrench 20, the wide range of recesses comprised 23*a*, 23*b*, 23*c*, 23*d* in the lower part of the decoupling wrench 20 locks the bit from its protuberances, when a coupling wrench is engaged with the percussion hammer 50 and a force is applied in a first direction, it allows the bit to remain fixed and then it is unlocked from the decoupling wrench 20. Once unlocked, the bit still remains connected to the percussion hammer.

In this way, there is an embodiment of a system for replacing drill bits, the drill comprising a pivotable drill string 12 with a percussion hammer 50 that receives bits at its end, the system comprising:

- a decoupling wrench 20 mounted on the percussion hammer 50, the decoupling wrench 20 being movable between an extended position, in which the decoupling wrench 20 is aligned with a drill hole of the pivotable drill string 12, and between a retracted position, in which the decoupling wrench 20 is spaced away from the pivotable drill string 12, the decoupling wrench 20 comprising:
- a central slot to receive the bit coupled to the percussion hammer 50, and
- a wide range of recesses 23*a*, 23*b*, 23*c*, 23*d* located on the inner surface of the central slot, wherein the recesses 23*a*, 23*b*, 23*c*, 23*d* are arranged to accommodate protrusions of the percussion hammer bit 50 and prevent rotational movement of the bit when the bit is accommodated in the decoupling wrench 20;
- a coupling wrench 51 set up to apply torque to the percussion hammer 50 when the bit is positioned in the decoupling wrench 20;
- a bit storage device 30 comprising:
  - a bit cradle carriage 34 set up to move on rail 36 to align with the percussion hammer 50;
  - a bit housing 31 comprising a wide range of receptacles 31*a*, 31*b*, 31*c*, 31*d*, 31*e;*
- a drill control device set up to send a command and hydraulically actuate the decoupling wrench 20, the bit storage device 30, the engagement wrench 51 and the percussion hammer 50.

Figure 3:
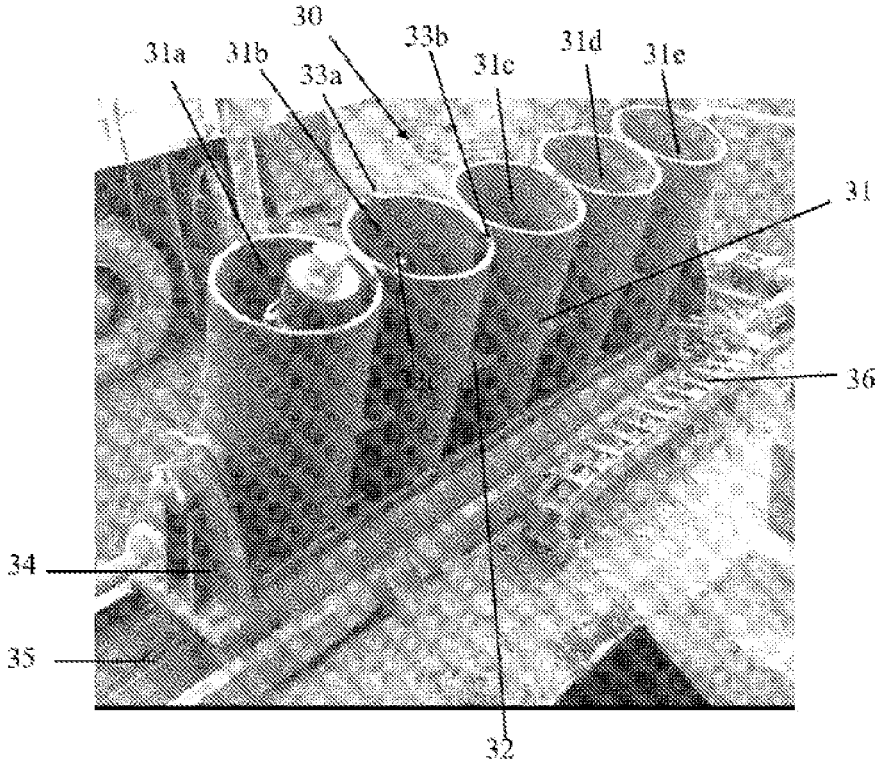
FIG. 3 shows the bit storage device.

FIG. 3 illustrates the bit storage device 30, which comprises the bit housing 31 with a wide range of receptacles 31*a*, 31*b*, 31*c*, 31*d*, 31 and connected by shaft 32, with locks 33*a*, 33*b*, 33*c* of recess and the bit cradle carriage 34. The bit storage device 30 is arranged in longitudinal movement mechanism 35 from conveyor 36, and can be electrically activated via a control from the operating cabin.

Figure 3A:
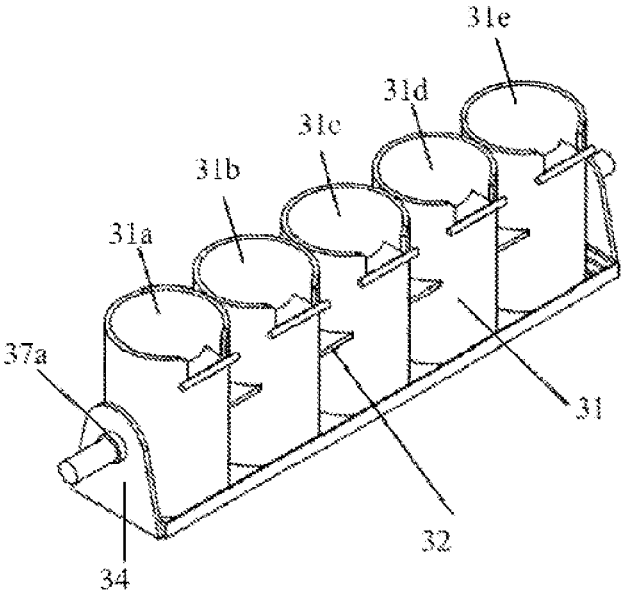
FIG. 3*a* shows an isometric view of the bit housing.

FIG. 3*a* represents an isometric view of the bit housing 31, which comprises a wide range of receptacles 31*a*, 31*b*, 31*c*, 31*d*, 31*e*. In the illustrated embodiment, there is the presence of five receptacles 31*a*, 31*b*, 31*c*, 31*d*, 31*e*, having a cylindrical shape and which are connected through shaft 32. The ends of the shaft 32 connecting receptacles 31*a*, 31*b*, 31*c*, 31*d*, 31*e* will fit into holes 37*a*, 37*b* located at the ends of the bit cradle carriage 34, which will allow receptacles 31*a*, 31*b*, 31*c*, 31*d*, 31*e* are tilted from a command in the operating cabin 14. The worn bits will be deposited in receptacles 31*a*, 31*b*, 31*c*, 31*d*, 31*e* and the spare bits will be installed in the percussion hammer 50.

Figure 3B:
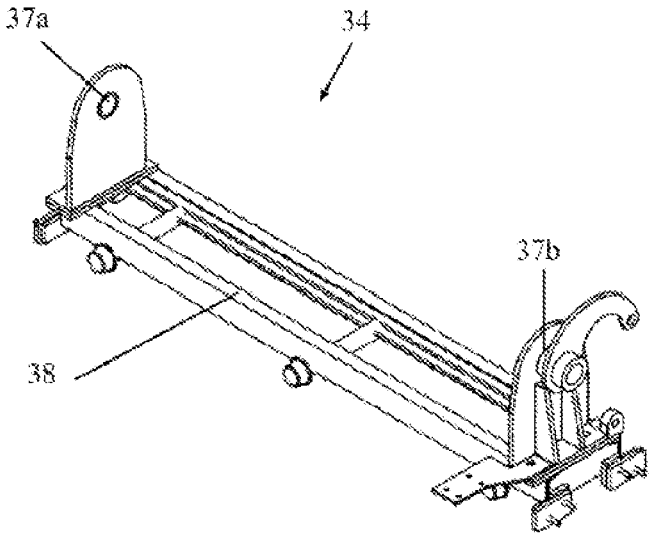
FIG. 3*b* shows an isometric view of the bit cradle carriage where the bit housing is installed.

FIG. 3*b* represents bit cradle carriage 34, where the bit housing 31 will be coupled to its base 38. Additionally, the ends of shaft 32 connecting receptacles 31*a*, 31*b*, 31*c*, 31*d*, 31 and bit housing 31 will be inserted into holes 37*a*, 37*b* of bit cradle carriage 34, allowing receptacles 31*a*, 31*b*, 31*c*, 31*d*, 31*e* are tilted to a replacement orientation hydraulically from a command in the operating cabin. The bit cradle carriage 34 is arranged in longitudinal movement mechanism 35 that allows the bit housing 31 to be aligned with the drill string 12 through position sensors to carry out the bit replacement process.

Figure 4:
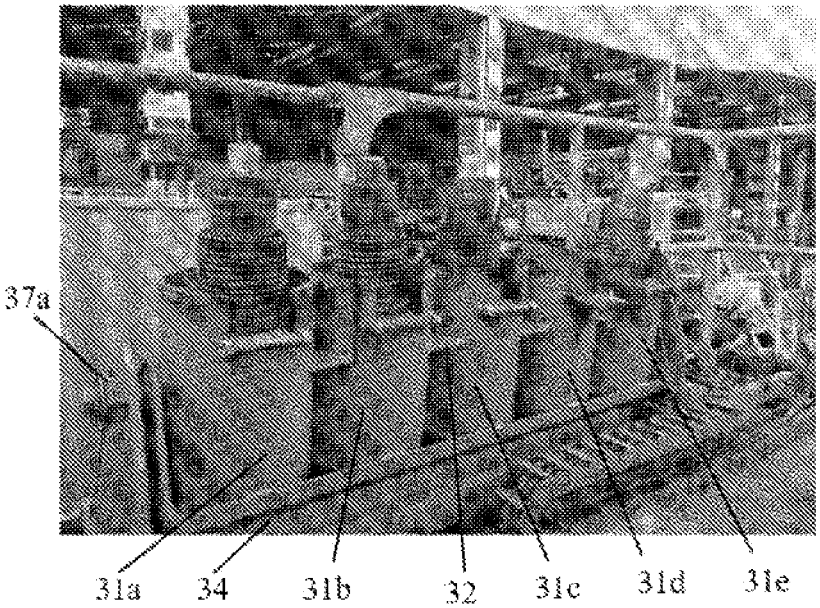
FIG. 4 shows a view of an alternative embodiment of the bit storage device.

Referring to FIG. 4, an alternative embodiment of the bit storage device is shown, wherein one of a wide range of receptacles is empty and spare bits are positioned in a wide range of receptacles 31*a*, 31*b*, 31*c*, 31*d*, 31*e*.

Figure 5:
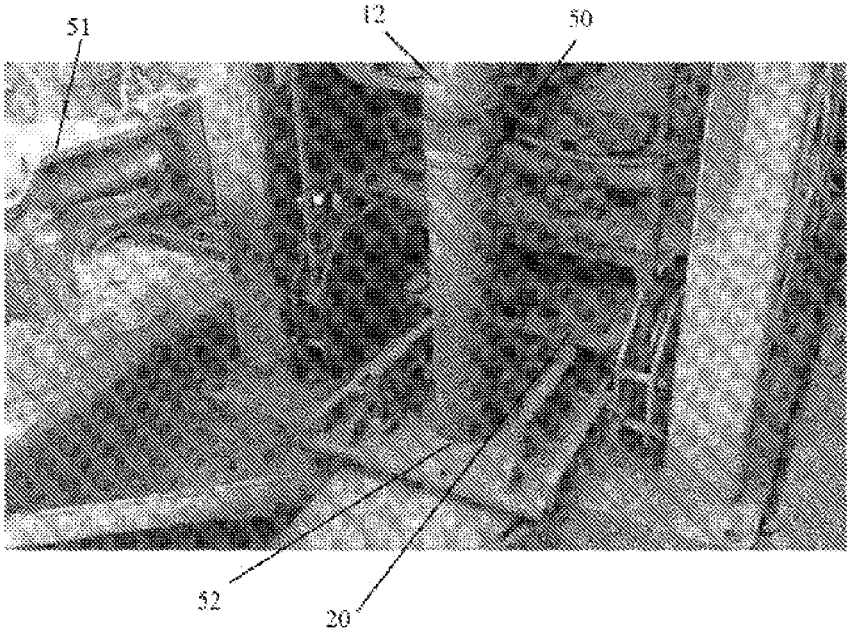
FIG. 5 shows a perspective view of a portion of the drill, illustrating the part of the drill string and the percussion hammer.
Figure 5A:
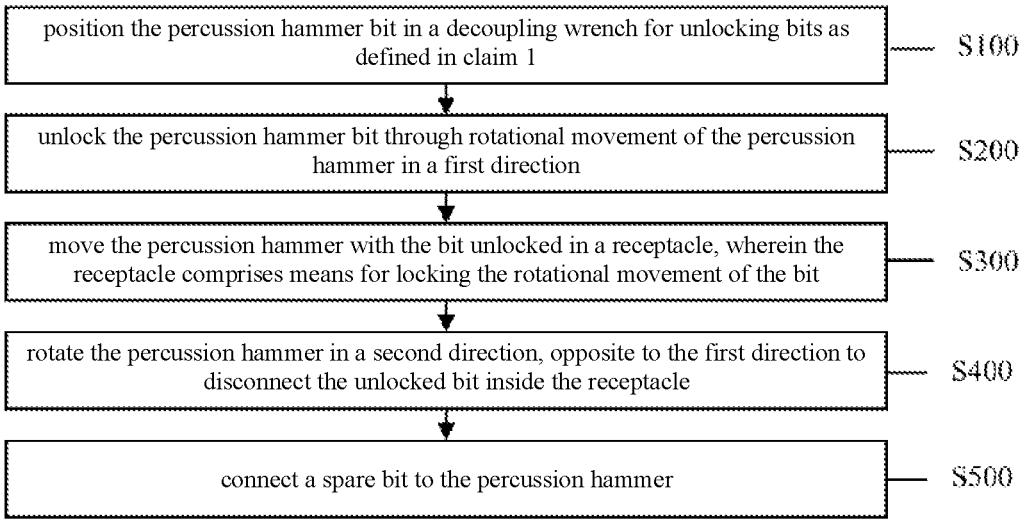
FIG. 5*a* presents a flowchart containing the bit replacement steps

With reference to FIG. 5, a part of the drill string 12 is shown with the percussion hammer 50 coupled, together with the presence of a coupling wrench 51 and a decoupling wrench 20 in the retracted position. As illustrated in FIG. 5, the drill string 12 is in a drilling orientation, extended vertically downward, in wellbore 52. Therefore, from this set-up, it will be possible to start the method for replacing drill bits, which, as shown in FIG. 5*a*, comprises the steps of:

- position S100 the percussion hammer bit 50 on a decoupling wrench 20 for unlocking bits;
- unlock the percussion hammer bit S200 by rotating the percussion hammer in a first direction;
- move the percussion hammer 50 with the bit unlocked S300 to a receptacle, wherein the receptacle comprises means for locking the rotational movement of the bit;
- rotate (S400) the percussion hammer 50 in a second direction, opposite to the first direction, to disconnect the unlocked bit inside the receptacle.
- connect (S500) a spare bit to the percussion hammer.

Figure 6:
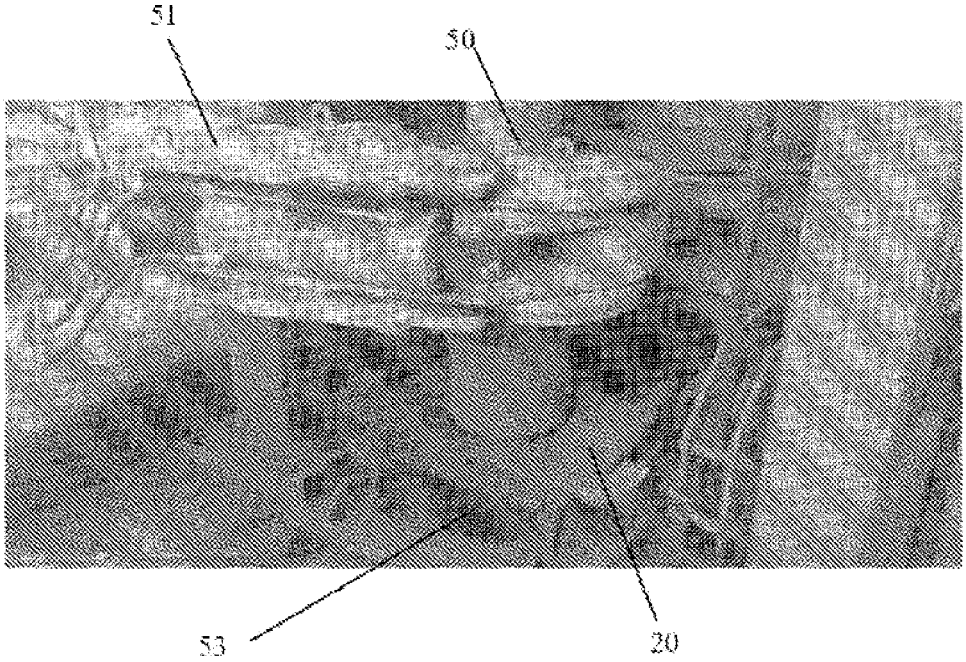
FIG. 6 shows the moment of torque break of the bits, where the bit is unlocked from the percussion hammer, through the use of a coupling wrench and a decoupling wrench.

FIG. 6 shows the beginning of the S100 method of unlocking a worn bit 54 of the percussion hammer 50, where upon a command from the operating cabin 14, the drilling process will be stopped. After stopping the drilling process, the lower end of the drill string 12, comprising the percussion hammer 50 will be removed from the drill hole 53.

Then, upon a command from a communication device in the operating cabin 14, the position of the decoupling switch 20, which is mounted on a pair of hydraulic cylinders 54*a*, 54*b*, will be changed from retracted to extended by sliding and then the percussion hammer 50 of the drill string 12 will be connected to the decoupling wrench 20. In this way, as further shown in FIG. 6, the protrusions of the worn bit 54 will be fixed in the recesses 23*a*, 23*b*, 23*c*, 23*d* of the central slot 22 of the decoupling wrench 20. Subsequently, coupling wrench 51 will engage the percussion hammer 50 and then the coupling wrench 51 will apply a force to unlock the percussion hammer bit S200 through rotational movement of the percussion hammer in a first direction. In this way, the percussion hammer 50 will be rotated while the worn bit 54 will remain attached to the decoupling wrench 20, allowing the bit to be unlocked but remain connected to the percussion hammer 50.

Figure 7:
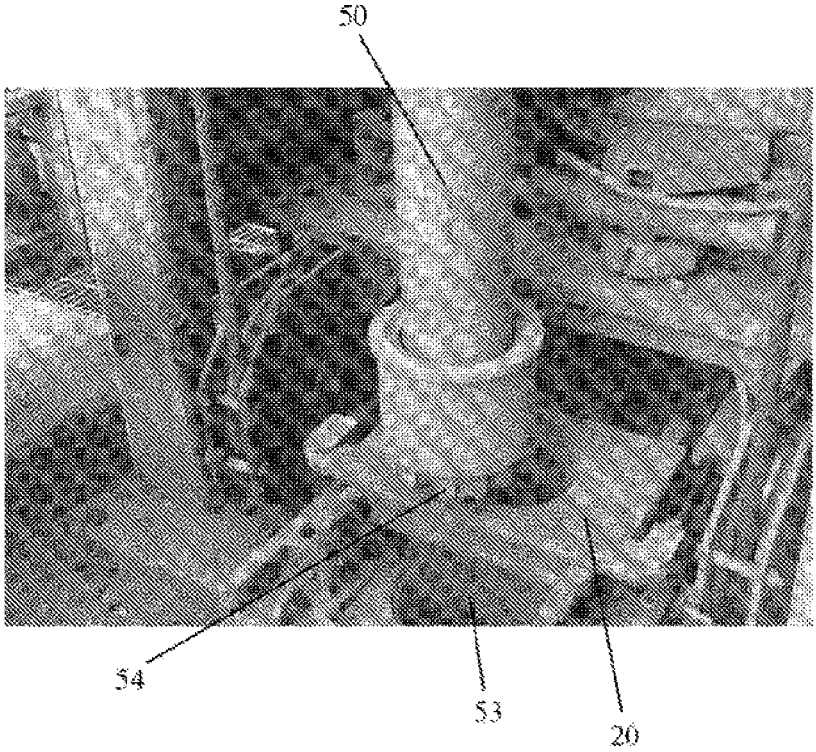
FIG. 7 shows the worn bit being prepared for replacement.

In this way, as shown in FIG. 7, the coupling wrench 51 and decoupling wrench 20 will be disconnected from the percussion hammer 50. The worn bit 54, although unlocked, remains attached to the percussion hammer 50 and outside the drill hole 53.

Figure 8:
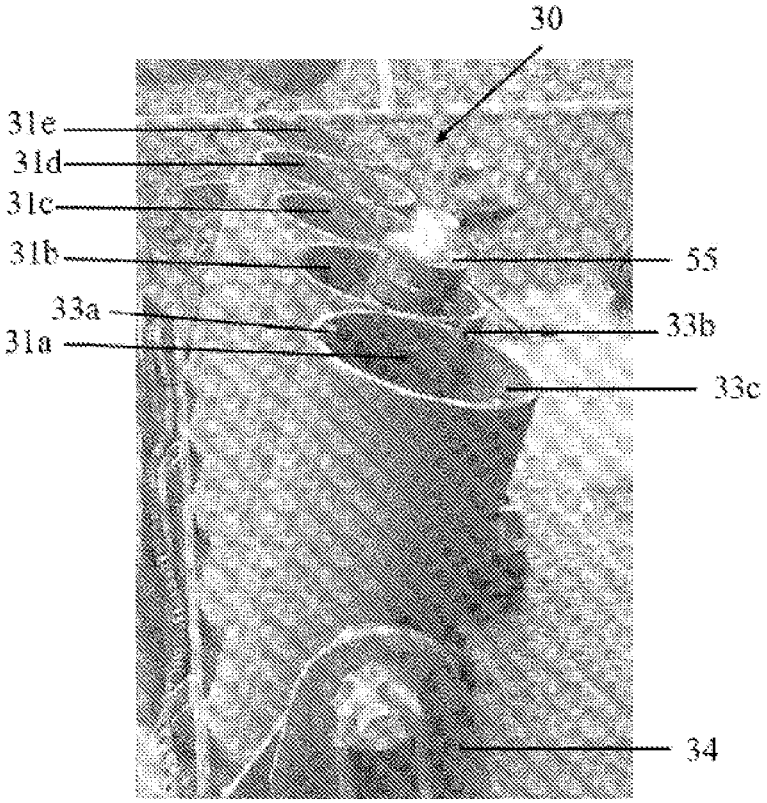
FIG. 8 shows the bit storage device with a spare bit in a receptacle.

In FIG. 8, it is possible to view the bit storage device 30 in a waiting position, where the first receptacle 31*a* that is empty will receive the worn bit 54. A second receptacle 31*b* with the spare bit 55 will replace the worn bit 54 in the percussion hammer 50. Still in FIG. 8, it is possible to see anti-rotation locks 33*a*, 33*b*, 33*c* in the receptacles 31*a*, 31*b*, which prevent the bit 54, 55 from being rotated inside the receptacle when the percussion hammer 50 is rotated.

Figure 9:
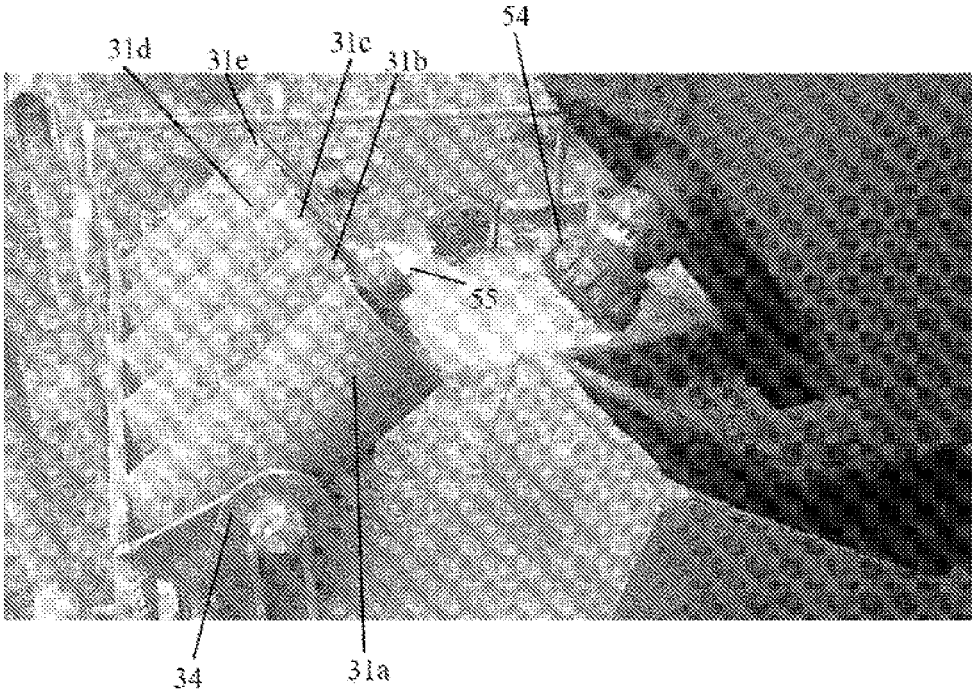
FIG. 9 shows a portion of the drill tilted with the unlocked worn bit being positioned toward a bit storage device.

Then, FIG. 9 shows the drilling derrick 11 positioned in a replacement orientation, allowing the drill string 12 to be extended S202 with the worn bit 54 in a replacement orientation. Still in FIG. 9, the bit storage device 30 is shown, which comprises the bit cradle carriage 34, where in its wide range of receptacles 31*a*, 31*b*, 31*c*, 31*d*, 31*e*, there is the presence of at least one empty receptacle 31*a*, which will be used to deposit the worn bit 54 and at least one receptacle 31*b* containing the spare bit 55.

Figure 10:
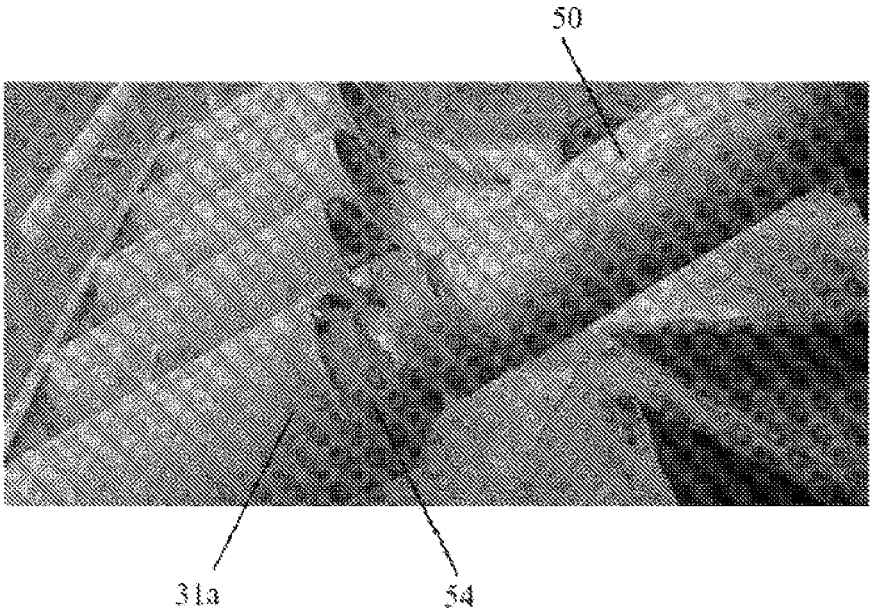
FIG. 10 shows the worn bit being deposited in an empty receptacle of the bit storage device, where the percussion hammer remains in the drill string.

In FIG. 10, the bit housing 31, through an electrical drive, will be tilted into a replacement orientation and, a wide range of receptacles 31*a* that is empty, will be aligned with the drill string 12. Next, the step of moving the percussion hammer 50 with the unlocked bit to the receptacle S300 will be carried out, wherein the receptacle comprises means for locking the rotational movement of the bit. The worn bit 54 will be secured by the anti-rotation locks 33*a*, 33*b*, 33*c* of the receptacle 31*a*, and the drill string 12 will perform the step of rotating the percussion hammer 50 in a second direction, opposite to the first direction, to disconnect the unlocked bit inside the receptacle 31*a*.

Figure 11:
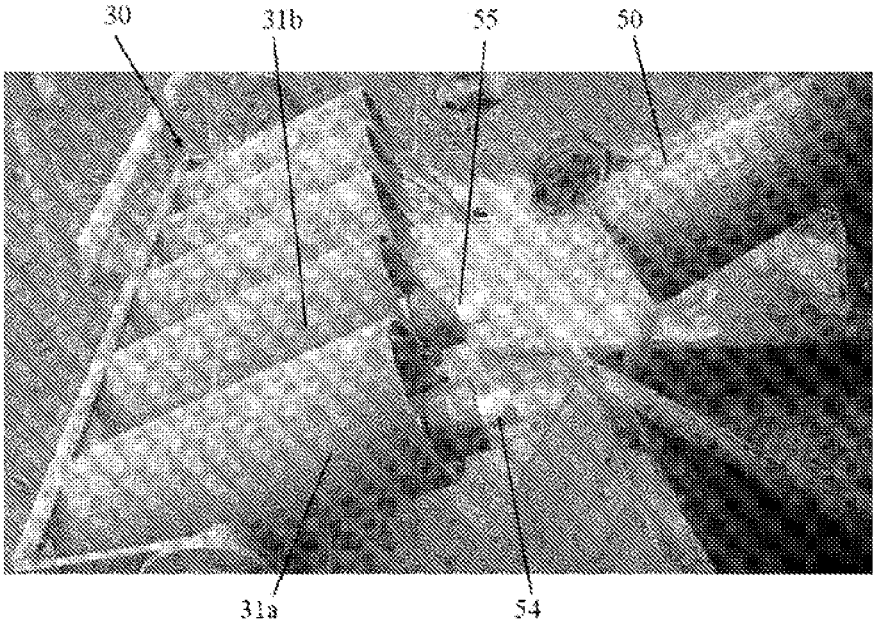
FIG. 11 shows the percussion hammer being positioned toward a receptacle of the bit storage device that contains a spare bit that is not worn.

In this way, it is shown in FIG. 11 that only the worn bit 54 was deposited in the receptacle 31*a* and the percussion hammer 50 remained in the drill string 12. Then, still in FIG. 11, the drill string 12 without the worn bit 54 is retracted and the bit storage device 30 is moved to align the receptacle 31*b*, through position sensors, with the spare bit 55 with the string. drill bit in its retracted position.

Figure 11A:
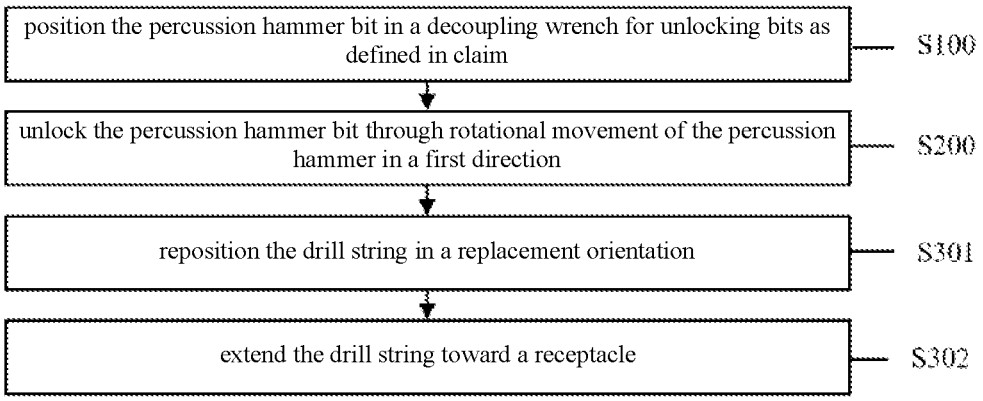
FIG. 11*a* presents a flowchart containing the steps of repositioning and extending the drill string.

As per FIG. 11*a*, the steps of repositioning S301 the drill string in a replacement orientation and extending S302 the drill string toward the receptacle 31*b* will be initiated.

Figure 12:
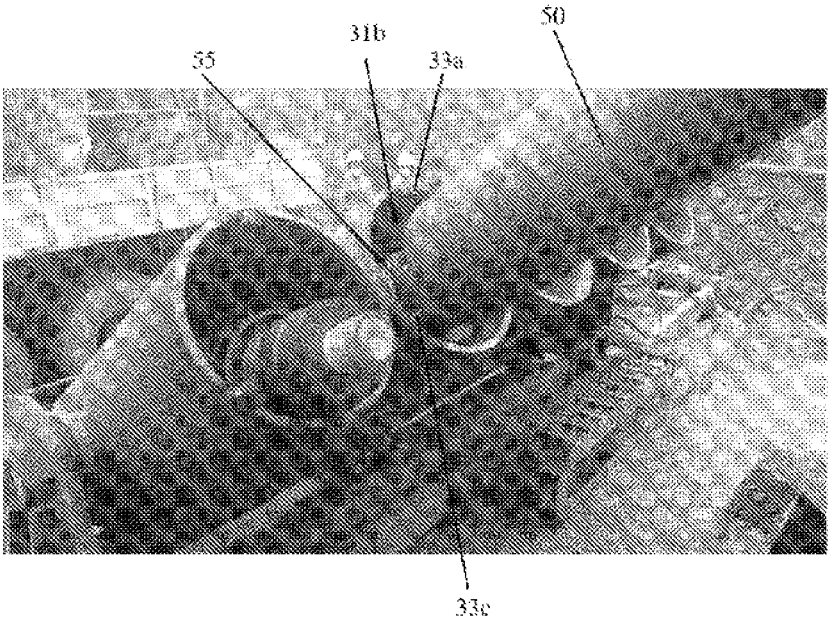
FIG. 12 shows the percussion hammer positioned towards the receptacle of the bit storage device that contains a spare bit that is not worn out.
Figure 12A:
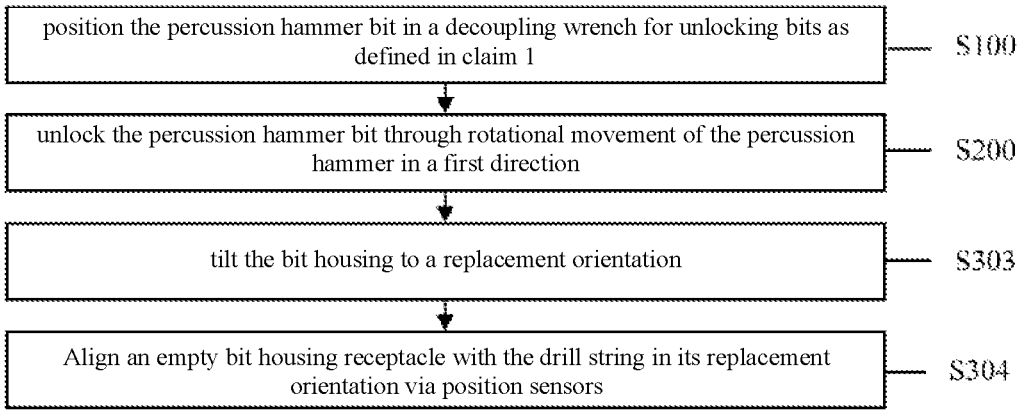
FIG. 12*a* presents a flowchart containing the steps of tilting a bit housing and aligning a receptacle.
Figure 12B:
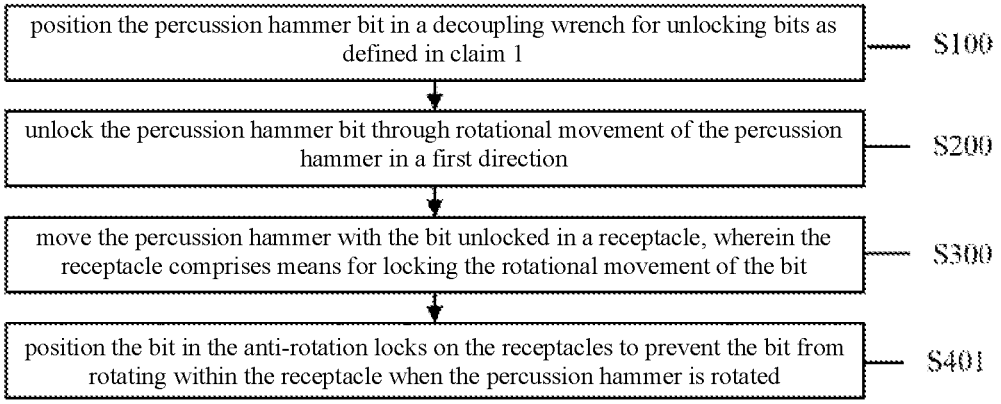
FIG. 12*b* shows a flowchart containing the step of positioning the bits in the anti-rotation locks.

FIG. 12 displays the steps of the flowchart of FIG. 12*a*, of tilting S303 the bit housing to a replacement orientation and aligning S304 an empty bit housing receptacle with the drill string, via position sensors, in its replacement orientation. Additionally, FIG. 12 also shows the steps of the flowchart of FIG. 12*b*, in which the steps of rotating S400 the percussion hammer 50 in a second direction, opposite to the first direction, will be performed to disconnect the unlocked bit inside the receptacle, where the bit will be positioned S401 in the anti-rotation locks on the receptacles to prevent bit 54, 55 from being rotated within the receptacle when the percussion hammer 50 is rotated.

Figure 13:
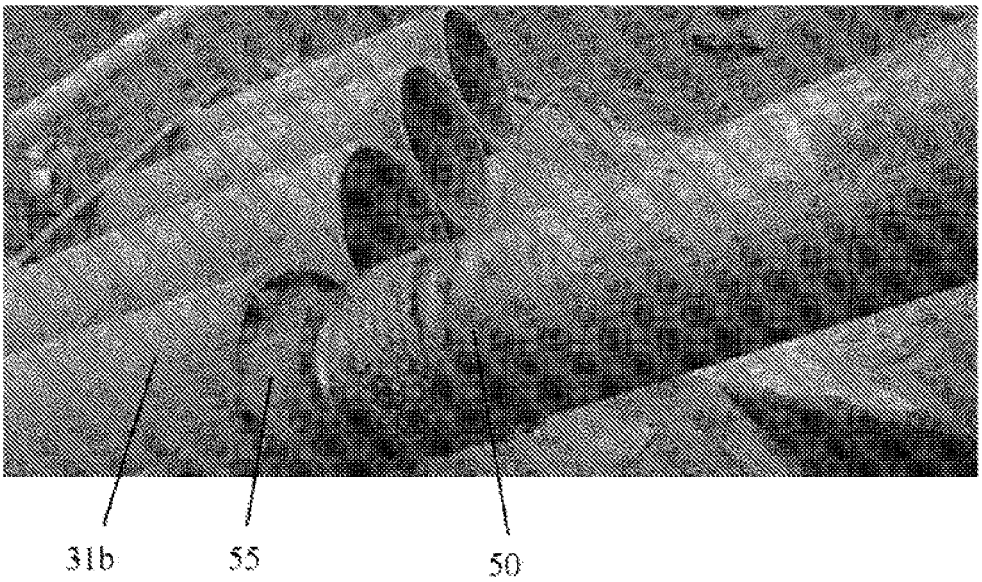
FIG. 13 shows the spare bit being removed from the receptacle and installed in the percussion hammer, which remains fixed in the drill string.
Figure 13A:
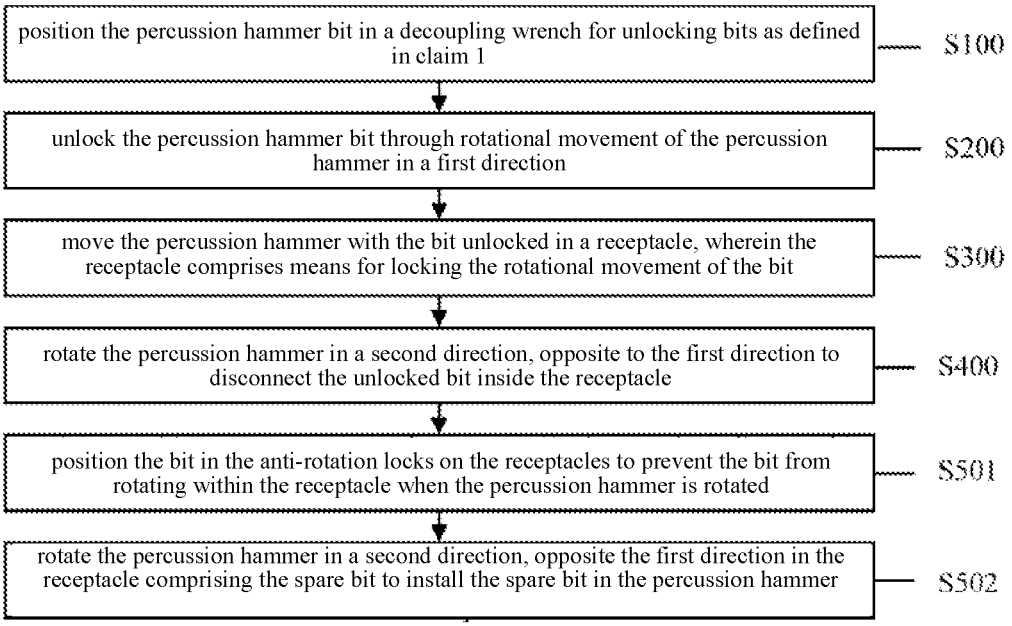
FIG. 13*a* shows a flowchart containing the step of rotating the percussion hammer.

FIG. 13 shows that after the worn bit 54 is disconnected from the percussion hammer 50, the drill string 12 is extended towards the receptacle 31*b* comprising the spare bit 55 which has been positioned S401 in the anti-rotation locks of the receptacle to prevent bit 55 from being rotated within the receptacle when the percussion hammer 50 is rotated. In this way, still as illustrated in FIG. 13 and the flowchart in FIG. 13*a*, the step of rotating the percussion hammer S500 in a second direction, opposite to the first direction in the receptacle comprising the spare bit for installing the spare bit into the percussion hammer.

Figure 14:
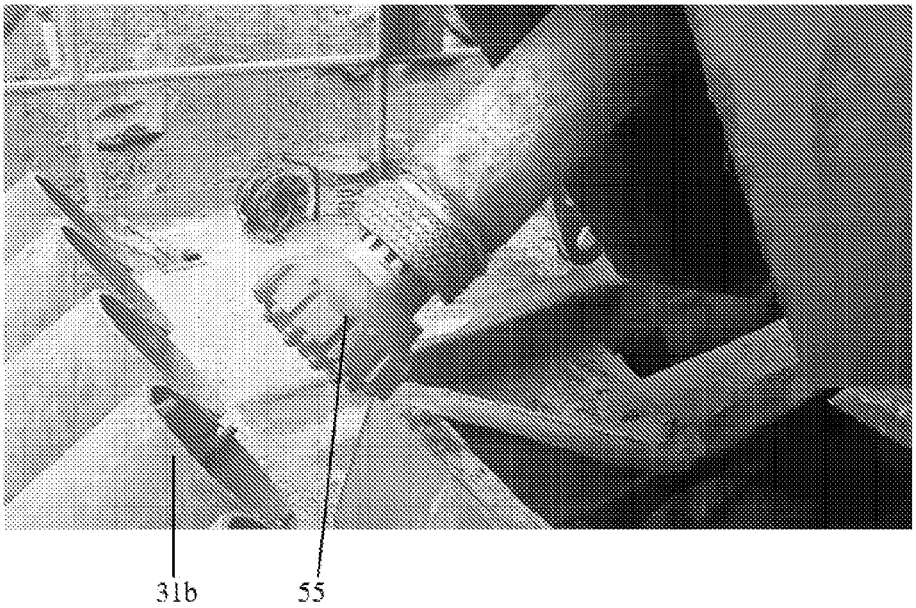
FIG. 14 shows the spare bit installed in the percussion hammer.

FIG. 14 shows the spare bit 55 installed and the receptacle 31*b* where said bit 55 was stored, empty.

Figure 15:
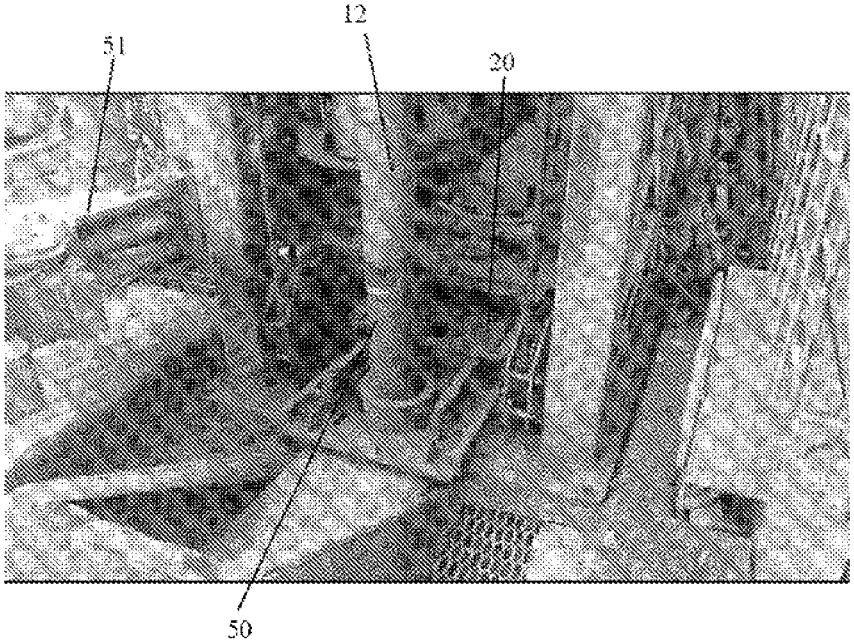
FIG. 15 shows the drill string in an extended position and ready to restart the drilling process.

FIG. 15 shows that after changing the worn bit 54, the drill string 12 returns to its drilling orientation and, in this way, restarts the drilling process from a command from a communication device in the operating cabin 13.

CONCLUSION

The benefit of using the decoupling wrench to unlock bits, the bit replacement system and the aforementioned method are directly related to reducing the interruption time of the drilling operation, since only the bit will be replaced and the percussion hammer will remain in the drilling derrick, adding to the cost reduction, since the use of the percussion hammer will be optimized, covering the entire useful life of the equipment. Another positive point with installing the device is the increased safety in operations, since the activity is carried out safely in the operator's cabin, with no exposure of people to the risks of limbs being pinched and crushed and falls from different levels. The electrical drive of the bit storage device provides greater reliability, safety and eliminates the possibility of hydraulic leaks, in addition to eliminating human-machine contact.

In this way, the use of the present decoupling wrench for unlocking bits, system and method of replacing bits is not limited to just one embodiment and can be applied to a wide range of drilling equipment, bringing numerous benefits of gaining productivity.

The invention claimed is:

1. A system for replacing bits of a drill, the drill comprising a pivotable drill string with a percussion hammer receiving the bits at an end, comprising:

a decoupling wrench mounted on the percussion hammer, the decoupling wrench being movable between an extended position, in which the decoupling wrench is aligned with a drill hole of the pivotable drill string, and between a retracted position, in which the decoupling wrench is spaced away from the pivotable drill string, the decoupling wrench comprising:

a central slot to receive the bit coupled to the percussion hammer, and a plurality of recesses located on an inner surface of the central slot, wherein the recesses are arranged to accommodate protrusions of the percussion hammer bit and prevent rotational movement of the bit when the bit is accommodated in the decoupling wrench;

a coupling wrench set up to apply torque to the percussion hammer when the bit is positioned in the decoupling wrench; and a bit storage device comprising:

a bit cradle carriage set up to move on rail to align with the percussion hammer;

a bit housing comprising a wide range of receptacles connected by a shaft; and a drilling control device of the drill set up to actuate the decoupling wrench, the bit storage device, the coupling wrench and the percussion hammer.

2. The system for replacing drill bits according to claim 1, wherein the drilling control device of the drill is set up to hydraulically actuate the decoupling wrench, the bit storage device, the coupling wrench and the percussion hammer.

3. The system for replacing drill bits according to claim 1, further comprising position sensors;

wherein the bit cradle carriage is positioned on a longitudinal locomotion mechanism to move the bit cradle carriage laterally to align with the percussion hammer;

wherein the bit cradle carriage has a tilting mechanism for tilting and aligning the bit cradle carriage with the drill string.

4. The system for replacing drill bits according to claim 1, wherein the bit housing comprises five receptacles.

5. The system for replacing drill bits according to claim 1, wherein the receptacles have a cylindrical shape.

6. The system for replacing drill bits according to claim 1, further comprising:

a plurality of anti-rotation locks in the receptacles to prevent the bit from being rotated within the receptacle when the percussion hammer is rotated.

7. A method for replacing bits of a drill, the drill comprising a pivotable drill string with a percussion hammer receiving the bits at an end, comprising:

positioning the percussion hammer bit in a decoupling wrench for unlocking bits;

unlocking the percussion hammer bit by rotating the percussion hammer in a first direction;

moving the percussion hammer with the bit unlocked in a receptacle, wherein the receptacle comprises one or more anti-rotation locks for locking a rotational movement of the bit, wherein moving the percussion hammer comprises repositioning the drill string in a replacement orientation and extending the drill string toward a receptacle;

rotating the percussion hammer in a second direction, opposite to the first direction to disconnect the unlocked bit inside the receptacle;

connecting a spare bit to the percussion hammer;

tilting a bit housing to a replacement orientation; and aligning an empty bit housing receptacle with the drill string in its replacement orientation via position sensors.

8. The method for replacing the bits of the drill according to claim 7, wherein rotating the percussion hammer in a second direction, opposite to the first direction to disconnect the unlocked bit inside the receptacle, comprises:

positioning the bit in the anti-rotation locks on the receptacle to prevent the bit from being rotated within the receptacle when the percussion hammer is rotated.

9. The method for replacing the bits of the drill according to claim 7, wherein connecting the spare bit to the percussion hammer comprises:

positioning the bit in the anti-rotation locks on the receptacle to prevent the bit from being rotated within the receptacle when the percussion hammer is rotated; and rotating the percussion hammer in a second direction, opposite to the first direction in the receptacle comprising the spare bit to install the spare bit in the percussion hammer.

* * * * *